US005782528A

United States Patent [19]

Cioncada

[11] Patent Number: 5,782,528

[45] Date of Patent: Jul. 21, 1998

[54] FOLDING CHAIR

[76] Inventor: Enrico Cioncada, Viale del Bosco, 84100 Salerno, Italy

[21] Appl. No.: 849,765

[22] PCT Filed: Dec. 12, 1995

[86] PCT No.: PCT/EP95/04890

§ 371 Date: Jun. 12, 1997

§ 102(e) Date: Jun. 12, 1997

[87] PCT Pub. No.: WO96/18325

PCT Pub. Date: Jun. 20, 1996

[30] Foreign Application Priority Data

Dec. 12, 1994 [IT] Italy ..... SA94A0012

[51] Int. Cl.[6] ..... A47C 4/00

[52] U.S. Cl. ..... 297/60; 297/58; 297/48; 297/50

[58] Field of Search ..... 297/48, 50, 55, 297/58, 59, 60

[56] References Cited

U.S. PATENT DOCUMENTS 2,757,715 8/1956 Hendrickson ..... 297/58

FOREIGN PATENT DOCUMENTS 1238791 2/1980 France .
2454287 12/1980 France ..... 297/58
2507070 10/1982 France .
2140384 2/1973 Germany ..... 297/50
7508170 1/1976 Netherlands ..... 297/48

*Primary Examiner*—Laurie K. Cranmer
*Attorney, Agent, or Firm*—Watson Cole Stevens Davis PLLC

[57] ABSTRACT

A folding chair (1) which consists of a seat (5) foldable; two pairs of struts, front (2) and rear (3) which converge on and connect to the chair back (6) functioning as legs and being connected to each other respectively by a rear horizontal cross-bar (9) and a front horizontal cross-bar (8). The rear struts (3) are formed by two tubes (31, 32) slidable one inside the other, the internal tube (32) being fixed by at least one connector (7) to the top of the front strut (2) in correspondence with the chair back, the external tube (31) being fixed to its twin by said rear cross-bar (9). The partial extraction of the internal tube (32) from the external tube (31) occurring when the chair is lifted by the back (6) allows the rotation of the seat around the axis of said rear cross-bar (9).

7 Claims, 8 Drawing Sheets

FOLDING CHAIR

BACKGROUND OF THE INVENTION

The invention regards a folding chair equipped with an improved opening and closing mechanism.

It is well known that all types of folding chairs on the present the same problems: in order to open or close them, the user is obliged to use both hands. One hand holds the chair, usually by the back, while the other rotates the seat up or down, according to whether the chair is to be opened or closed.

Moreover chairs on the market, in addition to requiring both hands to open or close, oblige the user to bend down. This can be bothersome, particularly for the elderly.

A drawback that current folding chairs present is the tendency to overturn or close when subjected to eccentric loading of the seat. It is well known that it is dangerous to stand on the seat of a chair of this kind.

A further disadvantage is formed by the fact that when a folding chair is set up on an uneven surface or when one of its legs rests on a higher point of an uneven floor, the user assumes an uncomfortable and unstable position.

The FR-A-1 238 791 document discloses a folding chair where the rear element of the frame consists of a tube "U" shaped. In the interior of each parallel part of said tube slides a stick in a telescopic manner, so the chair can be easily folded.

SUMMARY OF THE INVENTION

The aim of this invention is to overcome the above mentioned problems. One aim in particular is to realise a perfected folding chair which requires the use of only one hand to open and close.

Another aim is that closing and opening the chair comes about automatically when the chair is respectively lifted or put down.

A further aim is to create a chair with a seat which remains stable when loaded eccentrically, and which maintains its stability even when mounted on an uneven surface.

The above objectives are reached through the realisation of a folding chair, the main features of which are according to claim 1.

In a preferred embodiment of the invention, the elements which connect the struts and cross-bars, as well as the end-pins of the chair back together, are modular, being composed of pairs of identical symmetrical half-shells, through which the struts and cross-bars pass or terminate when the said half-shells are bolted together.

Advantageously, the chair of the invention results more manageable than other types of folding chair.

BRIEF DESCRIPTION OF THE DRAWINGS

Further scope of applicability of the present invention will become apparent from the detailed description given hereinafter. However, it should be understood that the detailed description and specific example, while indicating a preferred embodiment of the invention, are given by way of illustration only, since various changes and modifications within the spirit and scope of the invention will become apparent to those skilled in the art from this detailed description and from the drawings, wherein.

DESCRIPTION OF THE INVENTION

Figure 1:
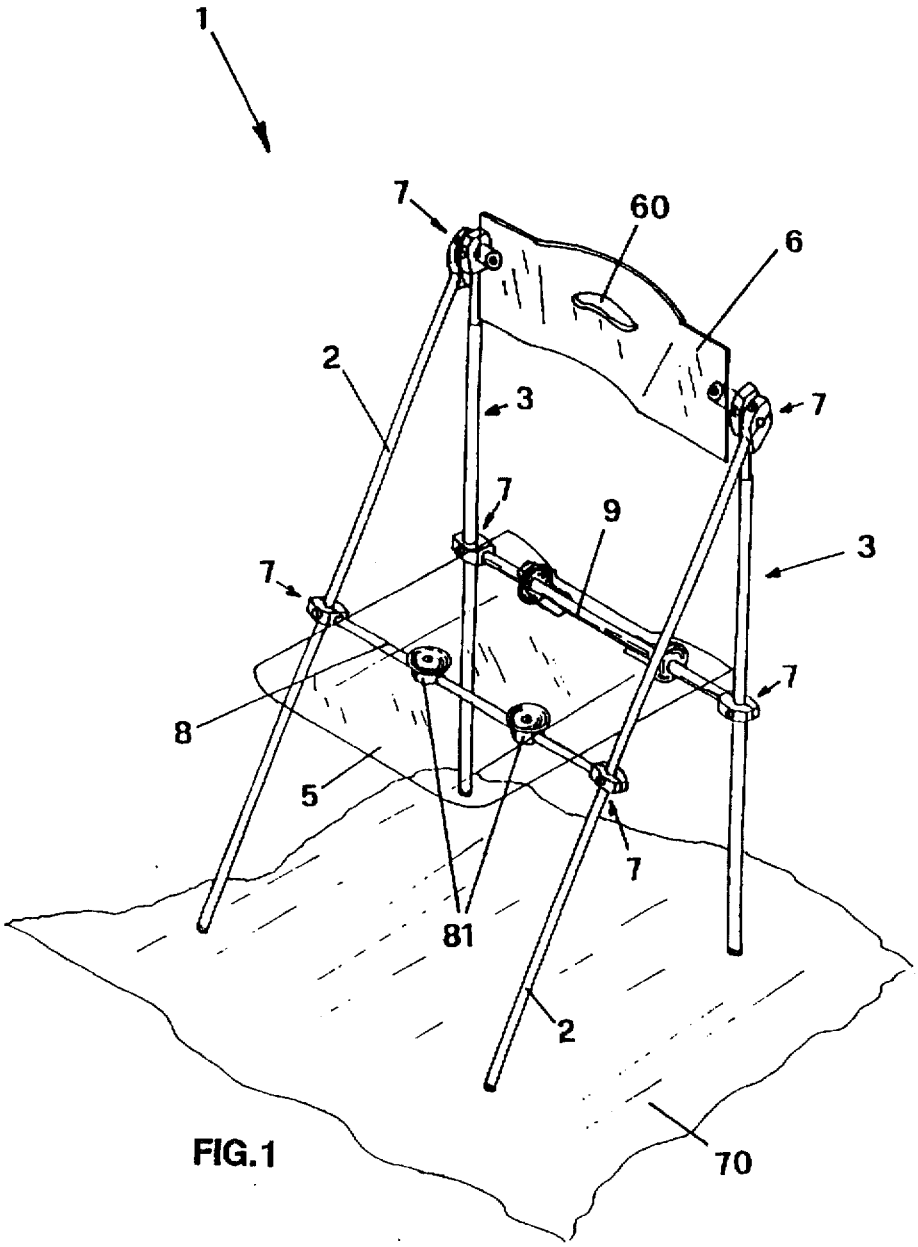
FIG. 1 The chair is shown in axonometric projection.

As can be seen in FIG.1, the folding chair of the invention is made up of a pair of front struts 2 and a pair of rear struts 3 serving as legs, which support the seat 5 and back 6 forming the chair. Of particular note, is that the back 6 is supported at its edges by connectors 7 which link it to the front and rear struts respectively 2 and 3 at their point of convergence, whereas the seat 5 is supported by a front cross-bar 8 and a rear cross-bar 9, these being fixed to the front and rear struts 2 and 3 by means of the same connectors 7 used to attach the back 6 to the struts 2 and 3.

Figure 4:
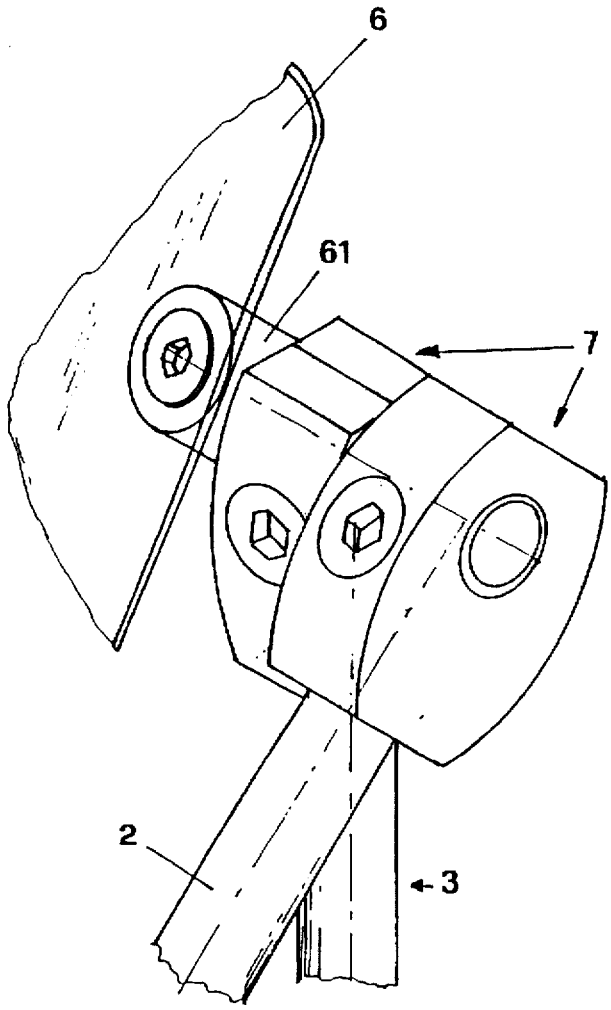
FIG. 4 Is an axonometric projection of the elements shown in FIG. 3 when assembled.
Figure 6:
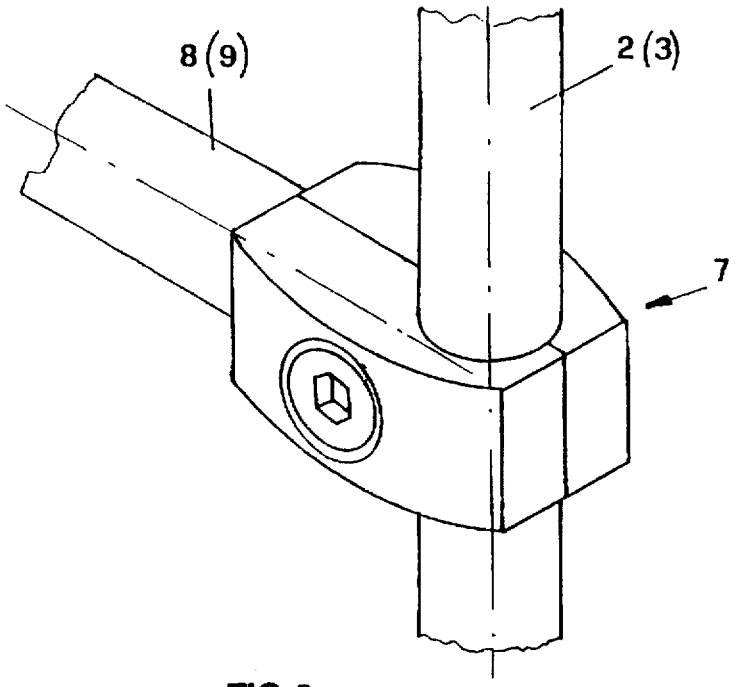
FIG. 6 Is an axonometric projection of the elements shown in FIG. 5 when assembled.

The connector 7 which attaches the struts 2 and 3 to the cross-bars 8 and 9 is seen in more detail in FIG. 6, and in FIG. 4 two of the connectors 7 are shown connecting the end-pins 61 of the chair back 6 to the converging top-ends of the struts 2 and 3, shown in FIG. 6 too.

Figure 3:
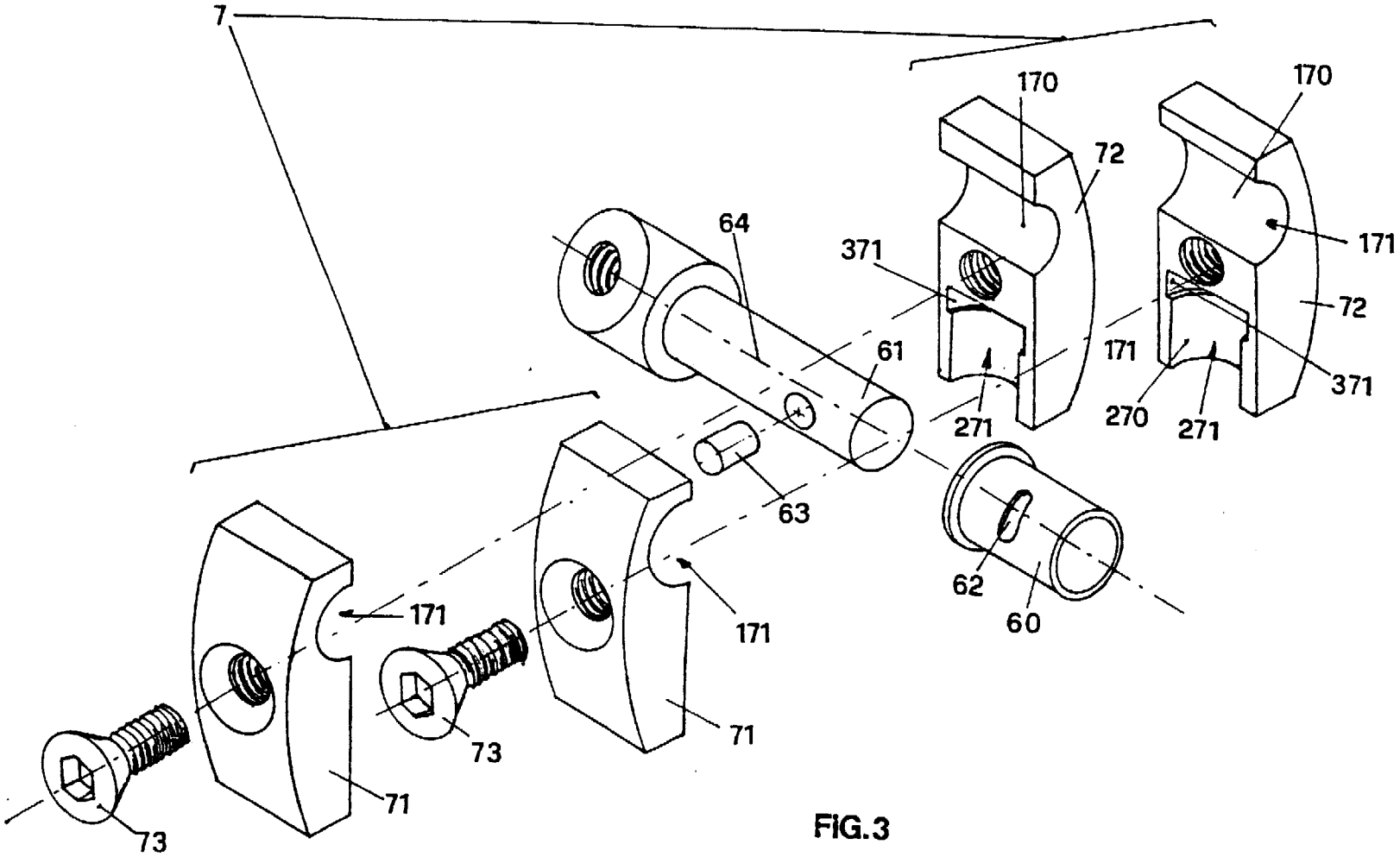
FIG. 3 Is an exploded view of the elements which connect the struts to the back of the chair.
Figure 5:
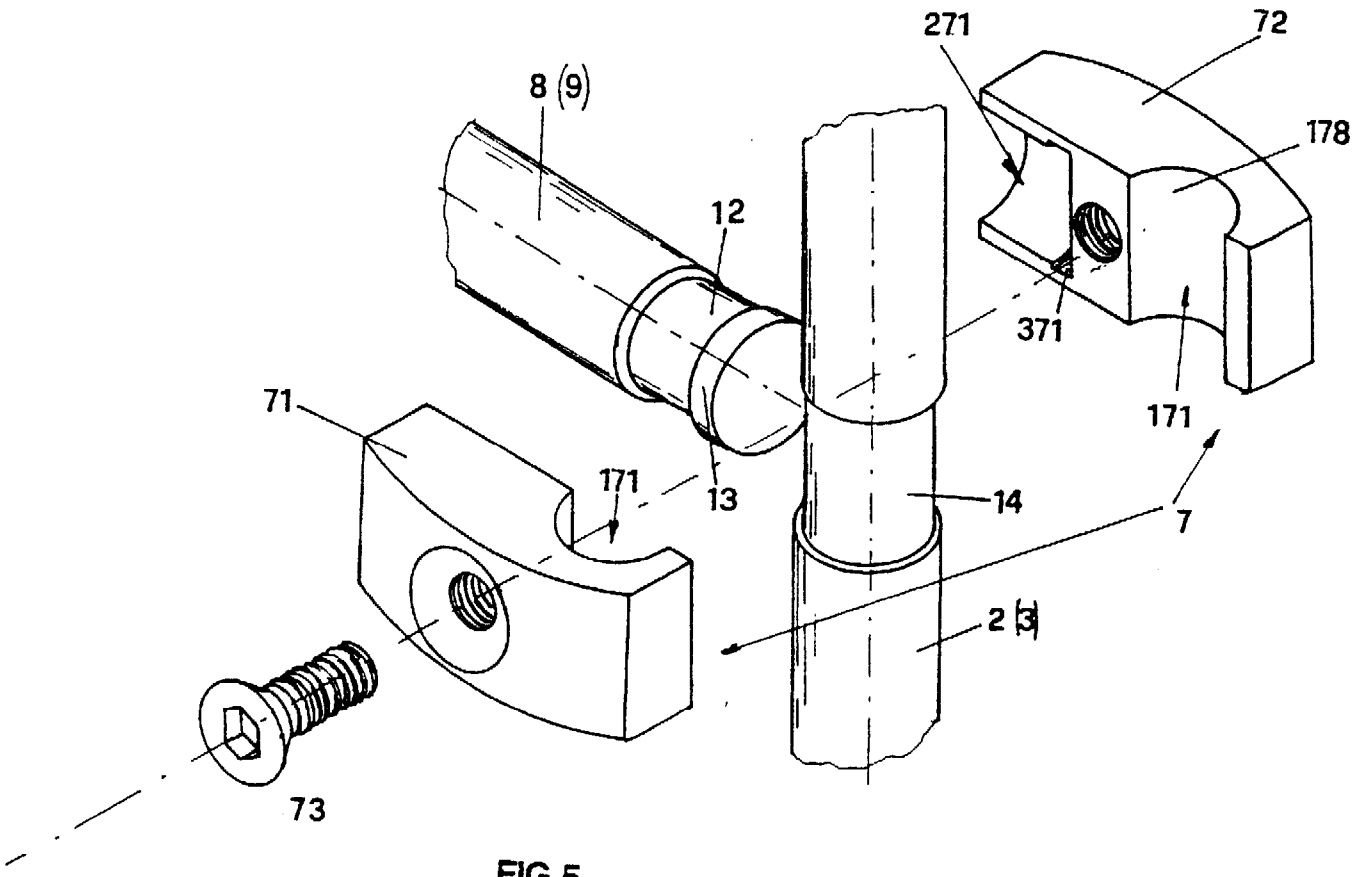
FIG. 5 Is an exploded view of the elements which connect a strut of the chair to its relative cross-bar.

These details are shown in exploded views in FIGS. 3 and 5. In FIG. 3 there is an exploded view of the connectors 7 which connect each of the end-pins 61 of the chair back 6 to the converging top ends of the struts 2 and 3 whereas FIG. 5 is an exploded view of the connectors 7 which connect each of the struts 2 or 3 to the relative cross-bars 8 or 9 which support the seat 5.

With regard to the connectors 7, in FIGS.3 and 5 it can be seen that they are composed of a first half-shell 71 and a second 72, these being symmetrical, which are reciprocally presented and united by a connecting bolt 73 such that the end-pin 61 is movable. Each of the half-shells has a through-cavity 170 and a blind-cavity 270, that when united form a through-hole 171 and a blind-hole 271.

In the details of FIGS. 3 and 5, it can be seen that the through-hole 171 houses a strut 2 or 3 which passes through, whereas in the blind-hole 271 a cross-bar terminates.

A detail which may be seen in FIG.5 is that in correspondence with the end of each of the cross-bars 8 or 9 there is an area of reduced diameter 12 which forms an end ring 13 which sits in a cavity 371 present in each of the blind-holes 270 of the half-shells which form the connector 7. This serves to lock the connector to the cross-bar once the half-shells are united. Similarly one can see in each of the struts an area of reduced diameter 14 which sits inside the through-hole 171 of the connector 7 serving to impede eventual movement between connector and strut.

Similarly, in FIGS.3 and 4 the connectors are disposed in such a way that the end-pin 61 passes through their through-holes 171 whereas the top ends of the struts 2 and 3 sit in their blind-holes 271. Similar to the cross-bars 8 and 9, though not shown in detail, the top ends of the struts seated in the two connectors 7 each have an end ring which couples with the seat 371 cut into the connector 7.

Furthermore each of the end-pins 61 is coupled to connectors 7 by a bush 60 which has a slot 62 in which runs a pin 63 transversely fixed into the end-pin 61. This allows the end-pin 61 and therefore the chair back 6 a limited oscillation around the axis 64 of the end-pin 61.

As can be seen in FIG. 1, the front cross-bar 8 is equipped with a couple of bushes 81 which are fixed to the seat 5 allowing the rotation of the same around the axis of the cross-bar 8 when opening or closing the chair.

Figure 2:
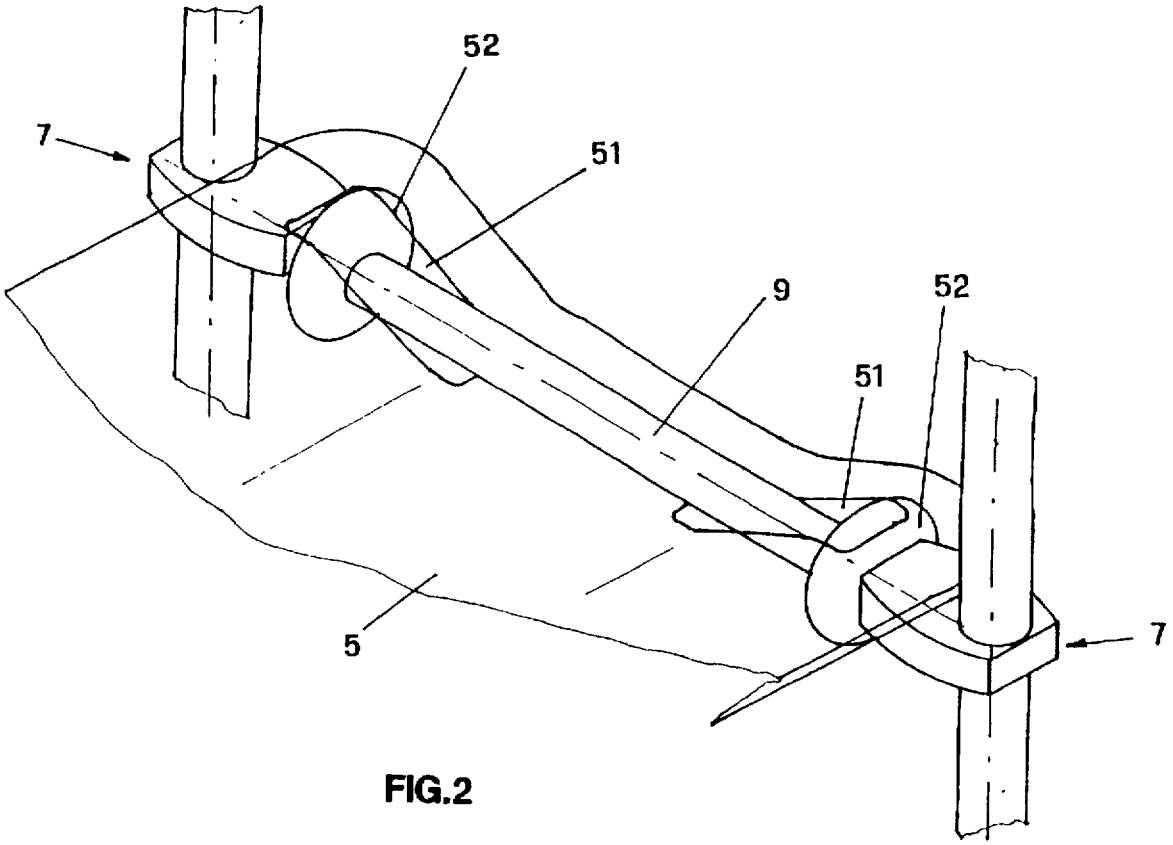
FIG. 2 There is an axonometric detail of the coupling which connects the seat of the invention to the rear cross-bar.
Figure 9:
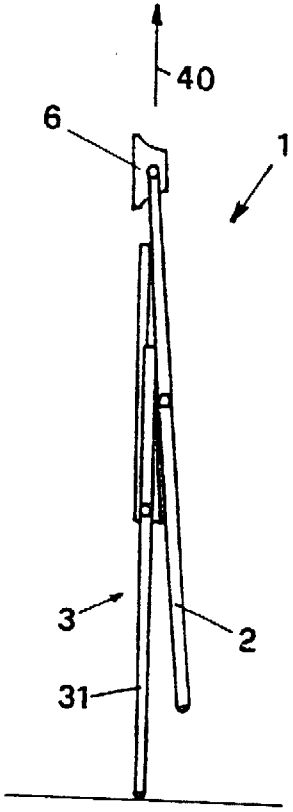
FIG. 8 and 9 show the chair as it closes automatically when lifted.
Figure 8:
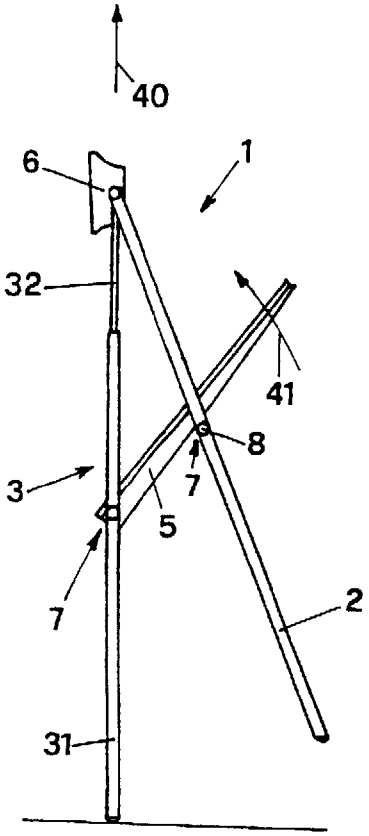
Figure 7:
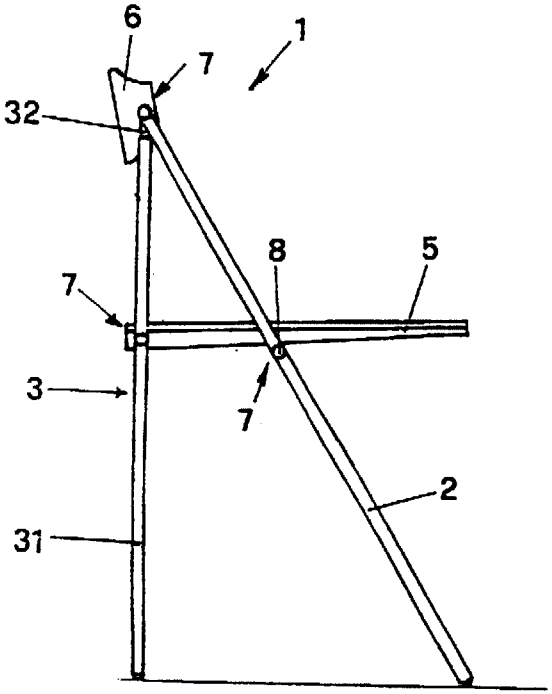
FIG. 7 Is a side projection of the seat in its open position.

Still with regard to the seat 5, FIG. 2 shows a pair of openings 52 through which the rear cross-bar 9, on which the seat 5 rests by means of the supports 52 placed adjacent to the connectors 7, passes. The aforementioned bushes 81, supports 52 and openings 51 in the seat 5 as well as the end-pins 61 which connect the chair back 6 to the struts, allow the reciprocal rotation of all the elements which make up the chair, seen in its open position in FIG.7. Therefore when the seat, as in FIGS. 8 and 9 is held by the handle 60 in the back 6 and lifted by a vertical force 40 the chair assumes the configuration seen in FIGS. 8 and 9, folding automatically. This folding is permitted by the fact that each of the rear struts 3 is telescopic, being composed of an external tube 31 and an internal tube 32. The internal tube is fixed to the chair back by means of previously described couple of connectors 7. In this way, when the chair 1 is lifted in direction 40, the internal tube 32 slides out of the external tube 31, and, being connected to the seat 5 at the point corresponding to the front cross-bar 8, applies a force which tends to rotate the seat 5 in an anticlockwise direction 41 seen in FIG. 8, bringing about the closure of the chair as in FIG. 9.

To effectuate the opposite operation, starting from the configuration represented in FIG.9, it is sufficient to put the chair down on its rear struts 3 and allow that the weight of the front struts 2 and of the seat 5 bring about the rotation of the seat 5 in a clockwise direction, the opposite of closure direction 41 shown in FIG. 8.

Figure 10:
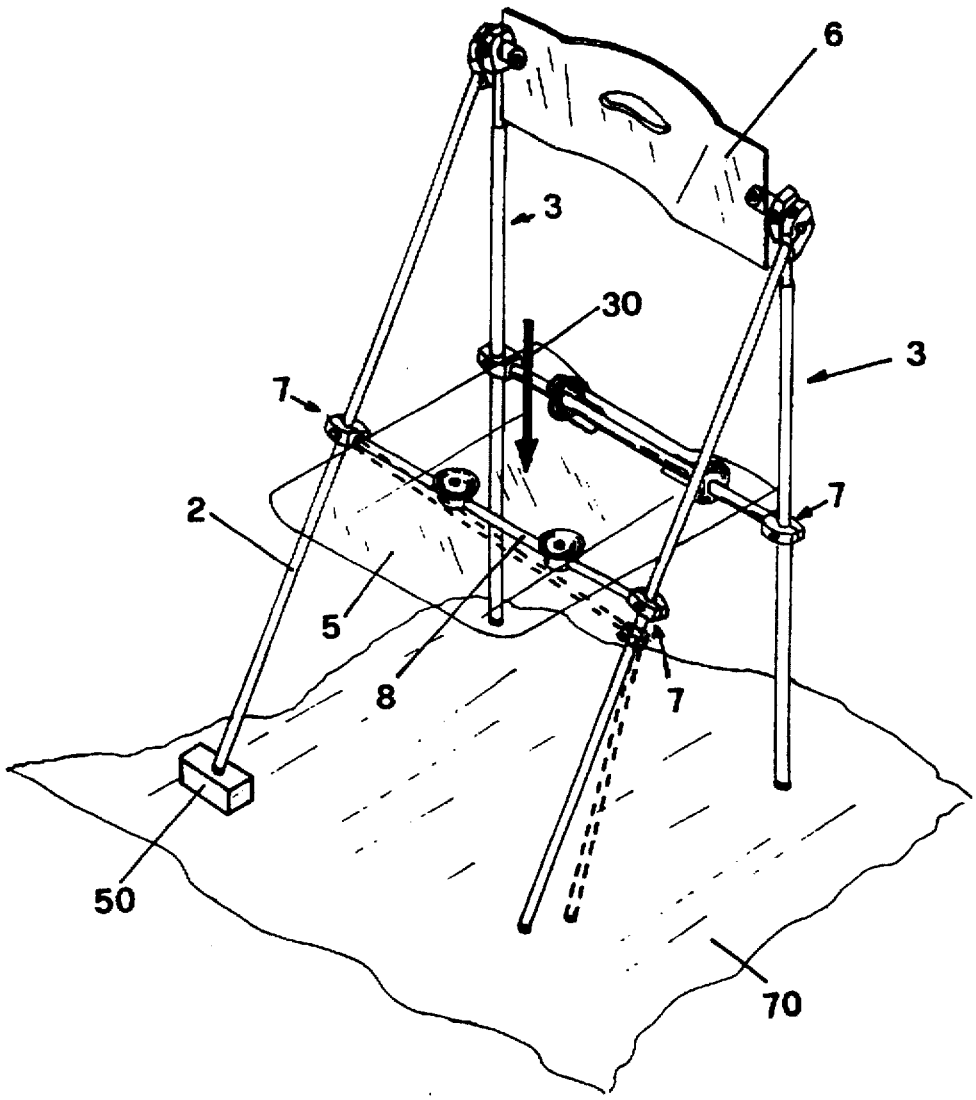
FIG. 10 Shows the position that the chair assumes when opened on an uneven surface.

It is important to note that when the chair 1 is set up on an uneven surface, for example as in FIG. 10, with one leg resting on a high point 50 of a pavement 70, the force 30 applied to the chair causes a deformation of the front struts 2 and front cross-bar 8 due to the intrinsic elasticity of the structure. Furthermore the connectors 7 behaving much like hinges, allow the structure to deform as in the dashed portion of FIG. 10 in such a way that all four struts of the chair rest on the pavement 70 guaranteeing a substantially horizontal position of the seat 5, which does not compromise the comfort of the user. When the force 30 is removed from the structure, the chair returns to its original form through its intrinsic elasticity and rotation about the connectors 7. This capacity to adapt to uneven surfaces also renders the chair stable whenever its seat is subjected to an eccentric load, making it possible to stand on the seat in total safety.

On the basis of this description it can be claimed that the invention reaches all of the previously established aims. The extreme ease of opening the chair has been illustrated, by simply putting the chair down, as has the ease of folding the chair, by simply lifting the back.

It has also been illustrated that the fact that the elements which form the chair are linked by connectors acting substantially as hinges, allowing the structure to deform elastically and adapt to uneven surfaces, with the added advantage of maintaining comfort and safety, even when the chair is subjected to eccentric loading.

It is clear that in manufacture, the invention may be realised in different forms and dimensions to those illustrated.

It is also clear that the connectors may be realised with different profiles and dimensions.

It is therefore to be made clear that eventual variants will be considered protected by this patent.

I claim:

1. A folding chair consisting of:

a seat foldable from horizontal to vertical and vice-versa;

two pairs of front and rear struts functioning as legs which converge on and connect to the chair back each pair of struts being connected to each other, through a rear horizontal cross-bar and a front horizontal cross-bar respectively by joint means;

a chair back connected to the front and rear struts at their point of convergence, by joint means; the rear struts being formed by two tubes slidable one inside the other, the internal tube being fixed to the top of the front strut in correspondence with the chair back, by means of at least one joint means, the partial extraction of the internal tube from the external tube of the rear strut, occurring when the chair is lifted by the back and allowing the rotation of the seat around the axis of said rear cross-bar characterised in that each of said joint means, which link the struts to the cross-bars, has a first hole through which the struts pass, and a second dead hole for coupling the end of each of cross-bars, this second dead hole having the bottom of the hole oversized in order to lock the end of the cross-bars said joint means being realized in two parts symmetrical with respect to the axis of dead hole.

2. The folding chair according to claim 1 wherein the struts present a section of reduced diameter in correspondence of the coupling point with said joint means.

3. The folding chair according to claim 1 wherein the end of each cross-bar presents a section of reduced diameter such as to create an end ring which sits in the oversized base of the joint means.

4. The folding chair according to claim 1 wherein the chair back presents two end-pins at its lateral extremities, each of which is housed in a coupled pair of said joint means, each of said joint means housing the top ends of the struts which converge on said end-pins.

5. The folding chair according to claim 4 wherein each of the end-pins is coupled to the joint means by the interposition of a bush which presents a slot in which runs a pin transversely fixed into the end-pin, said pin allowing the end-pin to have a limited oscillation around the axis of the end-pin itself, the chair back oscillating therefore around said end-pin.

6. The folding chair according to claim 1, wherein said front cross-bar is rotatingly attached to the seat by at least one bush fixed to said seat.

7. The folding chair according to claim 1, wherein said rear cross-bar passes through the seat in such a way as to allow rotation of said seat exclusively around the axis of said rear cross-bar.

* * * * *